US005566841A

United States Patent [19]

Evans et al.

[11] Patent Number: 5,566,841

[45] Date of Patent: Oct. 22, 1996

[54] BAR CLAMP HOLDER

[76] Inventors: Norris M. Evans, 4925 Chicago Ave., Fair Oaks, Calif. 95628; Michael E. Evans, 9465 Lake Natomas Dr., Orangevalle, Calif. 95662

[21] Appl. No.: 431,128

[22] Filed: Apr. 28, 1995

[51] Int. Cl.[6] ..... A47F 7/00

[52] U.S. Cl. ..... 211/70.6; 211/87; 211/90

[58] Field of Search ..... 211/87, 90, 70.6, 211/94, 13; 248/309.1

[56] References Cited

U.S. PATENT DOCUMENTS

| | | | |
|---|---|---|---|
| 925,577 | 6/1909 | Gordon | 211/70.6 X |
| 3,425,568 | 2/1969 | Albright | 211/87 |
| 3,603,551 | 9/1971 | Peterson | 211/89 |
| 3,749,252 | 7/1973 | Buschen | 211/70.6 |
| 4,141,452 | 2/1979 | Martin | 211/70.6 |
| 4,310,094 | 1/1982 | Hotchkiss, Jr. | 211/70.6 |
| 4,334,621 | 6/1982 | Weber | 211/89 |
| 4,345,688 | 8/1982 | De Boer | 211/70.6 |
| 4,365,720 | 12/1982 | Kaneshiro | 211/87 |
| 4,583,647 | 4/1986 | Schinzing | 211/70.6 X |
| 4,821,892 | 4/1989 | Randall | 211/90 |
| 4,880,192 | 11/1989 | Vom Bruacke | 211/70.6 X |
| 4,905,951 | 3/1990 | Putness | 211/70.6 |

*Primary Examiner*—Robert W. Gibson, Jr.

[57] ABSTRACT

A wall mounted bar clamp holder having an open mouth in the form of a U-shape: being comprised of an upper surface (1) which provides a means to capture (at 8) the nose portion of the fixed jaw of a bar clamp (indicated at 6 and 7 as reference only), and a lower surface (2) extending outward for a substantial portion of the width of the bar clamp holder, all of which allows means for the fixed and movable jaws of a commonly proportioned bar clamp to be closed around said lower surface.

3 Claims, 3 Drawing Sheets

FIGURE 1.
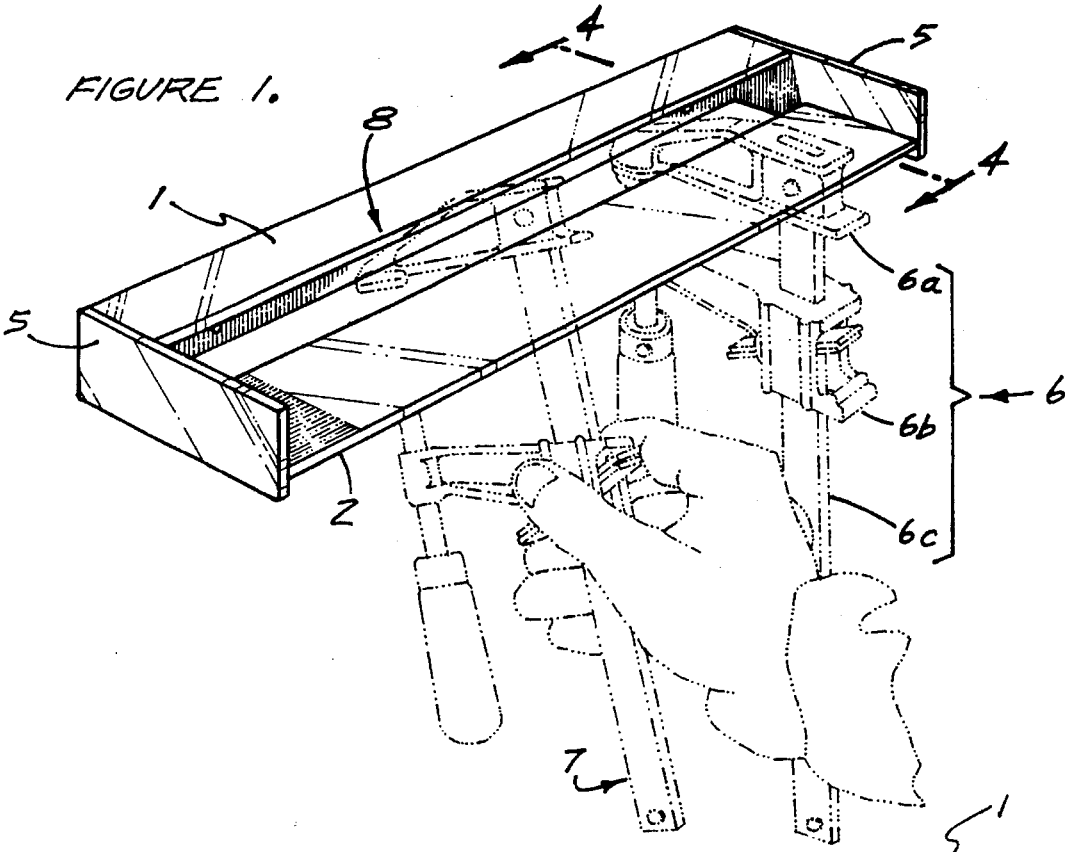
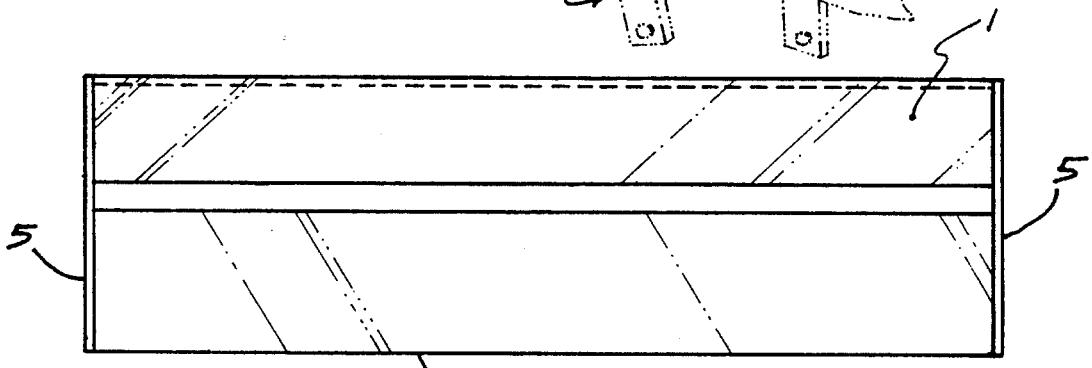
FIGURE 2.
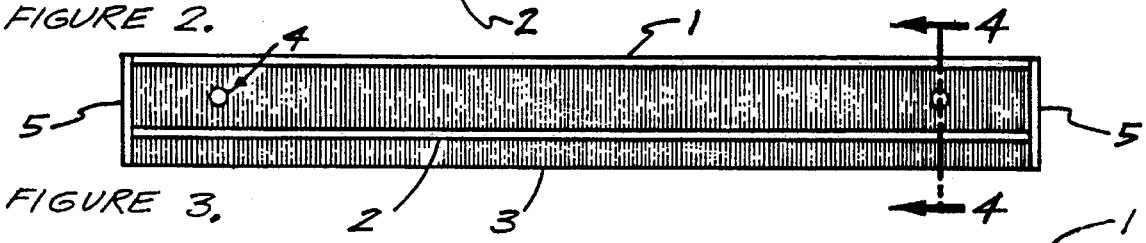
FIGURE 3.
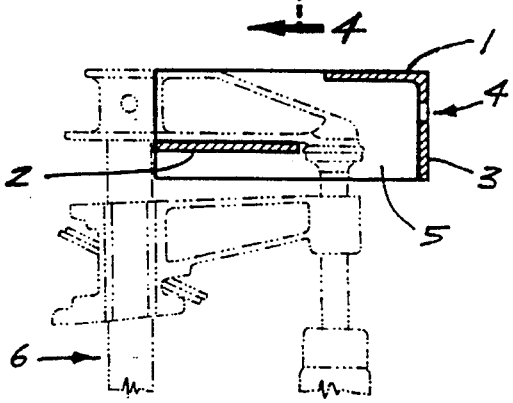
FIGURE 4

BAR CLAMP HOLDER

BACKGROUND OF THE INVENTION

The invention of the BAR CLAMP HOLDER describes a tool holder not the tool it holds. This holder represents a new approach to an old problem and its design is extremely simple. So simple, in fact, that these inventors are concerned that the design will be dismissed as inconsequential. It's not. It's just simple. It's so simple that people have overlooked it for the life of this planet—or, at least, for as long as bar clamps have been made.

According to these inventors, tool holders may be divided into two groups—"active" and "passive". An "active" holder is one which the holder grabs the tool (i.e., the holder has a spring, lever, sticky stuff or other). A "passive" holder is one in which the tool grabs the holder. The subject of this invention, the BAR CLAMP HOLDER, is a "passive" holder. It relies upon the tool to do the grabbing. Most "passive" holders exist just for one reason, and that is to provide a convenient place for the tool to reside. However, in the case of the BAR CLAMP HOLDER, subtle advantages exist that are not present on other holders.

As a general description of this invention, the BAR CLAMP HOLDER broadly relates to that category of supports, racks and holders that are primarily designed to hold or store a wide variety of hand held implements or tools. For the purposes of this invention, this wide variety of subject tools (that a tool holder is designed to hold) will be severely limited to only one type of tool, the bar clamp. And of this type, we further narrow the scope of this subject tool to only one subclass: the commonly proportioned bar clamp. The BAR CLAMP HOLDER is designed to hold only this type of tool and no other.

As a consequence of this limited focus, it is important to include in this paper reference description of this commonly proportioned bar clamp and how people use them. This description and explanation-of-use will demonstrate the annoying traits associated with present shop practice and will lead, in a natural and creative manner, directly into the design consideration and concept used in the invention of the BAR CLAMP HOLDER. The design concept, termed by the inventors as "capturing and holding", represents a new and novel solution to an old problem and, when applied to the design of the BAR CLAMP HOLDER, represents a great improvement over current shop practice and materially improves the bar clamp holders that are available today.

SUMMARY OF THE INVENTION

The object of this invention is to provide a means of storing bar clamps in a stable manner that allows convenient ingress or egress of clamps to or from the holder. To understand the background of this invention, we recommend a basic familiarity with the concept of the bar clamp and how people use them. FIG. 1 shows the first embodiment of the BAR CLAMP HOLDER in conjunction with renderings of two commonly proportioned bar clamps. Reference numeral 7 shows a phantom-in-action pose of a bar clamp as it is being put onto the holder. Reference numeral 6 indicates the positioning of a common bar clamp in a stationary and stored position. Numerals *6a*, *6b*, and *6c* are additional annotations which call out the three basic parts of a common bar clamp. Numeral *6a* is the fixed jaw, *6b* is the movable jaw and *6c* is the bar that defines the clamp and over which the movable jaw is allowed to travel. The movable jaw travels along the length of this bar—but in only one direction—and that is toward the fixed jaw. Backward movement, away from the fixed jaw, is allowed only if a lock-lever device located in the backside collar of the movable jaw is depressed. When a clamping situation arises, the bar clamp is placed on the object and the movable jaw is slid toward the fixed jaw so as to lightly grasp the object. Clamping pressure is applied via a turn screw built into the movable jaw. Removing the clamp from the object is accomplished by first unloading the clamping pressure and then sliding the movable jaw backward via depressing the lock-lever device. After use, the bar clamp is returned to its stored position in the workshop.

Using the bar clamp in this manner is easy and represents no particular difficulty—it's the storage of the bar clamp that causes the problem. The source of this problem lies with the shape of the tool. The clamp may vary in length from long to short and the movable jaw may take on any number of positions. In addition, there are numerous protuberances that seem to stick out in all directions. All of these physical traits contribute to the many disturbing situations which might occur when large numbers of bar clamps are stored. For example, storing bar clamps by stacking them, one on top of another, will invariable lead to the formation of a mass of interconnected, intertwined trouble. Stacking bar clamps is not recommended. Another method, hanging bar clamps on a nail is a much more acceptable solution and is the solution of choice among mechanics, wood workers, hobbyist and retail merchants. Hook the fixed jaw over a nail and all is solved. This is simple, cheap, and straightforward but it leads to yet another, but this time unobvious, problem. This unobvious problem expresses itself by the position the bar clamp takes as it hangs on the nail. If given enough time, plus the activity associated with a busy shop, the bar clamp will ultimately work its way down the face of the fixed jaw until it hangs precariously at the jaw's tip. This mysterious movement is further exacerbated by a slow rotation of the clamp until it reaches an oblique angle, aimed at the floor. All of this sounds as if the bar clamp has a mind of its own, but, instead, this mysterious movement is caused by the clamp's peculiar center of gravity in concert with the disturbances usually found in the shop and/or other outside influences. A slight breeze, for example, will send the bar clamp tumbling to the floor. Again, this "fall off" phenomenon is caused by the tool's center of gravity. It's something we can't do anything about, so we just learn to live with it and consider it the price we pay for the use of the tool. As a consequence, however, retrieving a bar clamp from the nail becomes a two handed procedure. One hand chooses the desired clamp while the other hand prevents the remaining clamps from falling off. In an attempt to offer an acceptable storage device, the foremost maker of bar clamps offers this product: a two inch wide, ten inch long arm. It's a wall mounted bracket with the ten inch portion protruding into shop space. It doesn't look like it at first, but it functions exactly like a ten inch long nail. Clamps fall off just as easily. In this case, the situation is made even worse because of the increase in stacking depth. A short nail holds only a few clamps, whereas this ten inch bracket holds up to ten clamps. Retrieving a particular bar clamp means that one hand holds nine while the other hand picks out the clamp needed for the job. This is certainly an exasperation situation and it spells the reason for the invention of the BAR CLAMP HOLDER.

This invention, in its broadest sense, is comprised of two parallel and horizontal surfaces. The upper surface functions to capture the nose of the bar clamp while the lower surface offers a place for the clamp to be secured. Both "on" and "off" operations of the bar clamp to the holder may be accomplished with the use of just one hand. The "on" operation is performed by placing the nose of the bar clamp beneath the upper surface of the holder while, and in the same motion, the movable jaw is slide up the bar to meet the fixed jaw. This operation automatically secures the clamp to the lower surface of the tool holder. The "off" operation of the bar clamp from the holder is accomplished by grasping the movable jaw of the desired clamp by the backside collar and bar and, while depressing the lock-lever device in the collar, the movable jaw is slide down the bar and the clamp is withdrawn from the holder. This is a simple one handed operation that happens in one sweeping motion and does not disturb the neighboring clamps.

In order that this invention may be more readily understood, we shall describe the first embodiment of this invention in detail, showing actual positionings of common bar clamps on the holder and then broaden this description to embodiments two and three. These three embodiments relate to different methods of manufacture; the basic mechanical concept remains the same.

The following is a description of the BAR CLAMP HOLDER in association with the accompanying figures:

BRIEF DESCRIPTION OF THE DRAWINGS

FIG. 1. A perspective view of the first embodiment of the BAR CLAMP HOLDER. Incorporated with this figure are demonstration renderings of two bar clamps. One clamp is shown in a stored position while the other is a phantom-in-action depiction of a bar clamp being put onto the holder, showing the nose of the fixed jaw being captured by the upper surface.

FIG. 2. Top view of the BAR CLAMP HOLDER of FIG. 1.

FIG. 3. Front view of the first embodiment of FIG. 1, showing, in true view, the two attachment holes.

FIG. 4. Side view and/or section view of the first embodiment of the BAR CLAMP HOLDER and contains, in addition, a profile view of a bar clamp in stored position.

DETAILED DESCRIPTION OF THE DRAWINGS

Figure 5:
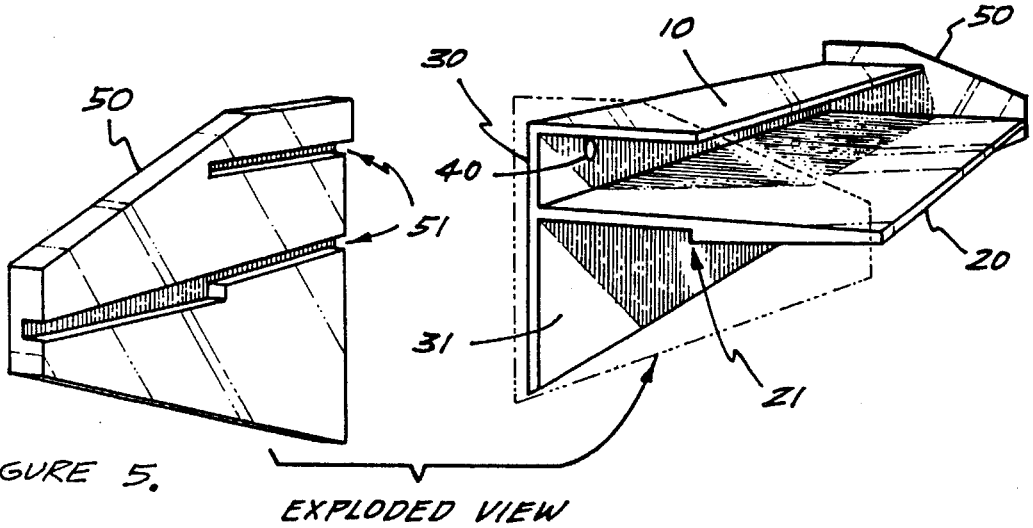
FIG. 5. A perspective and exploded view of the second embodiment of the BAR CLAMP HOLDER. The exploded detail shows the molded end plate plus recessed footprint and indicates the direction of assembly of the end plate onto the extruded section.
Figure 6:
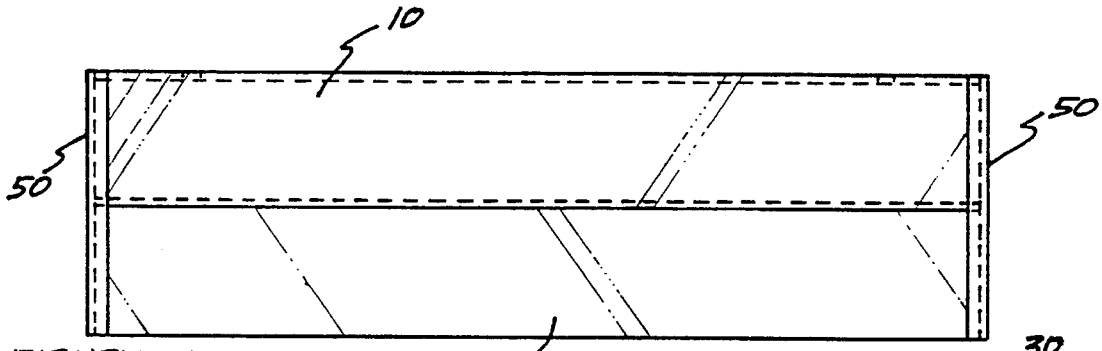
FIG. 6. Top view of the second embodiment of the BAR CLAMP HOLDER.
Figure 7:
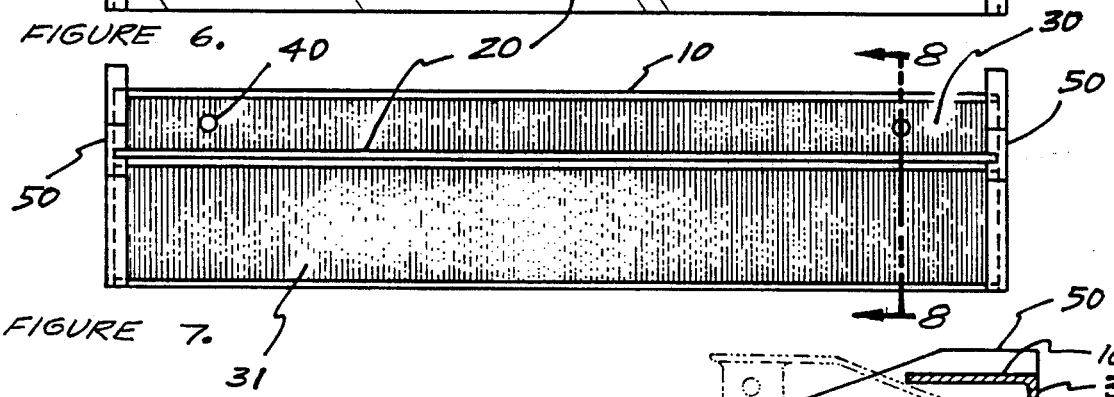
FIG. 7. Front view of the second embodiment.
Figure 8:
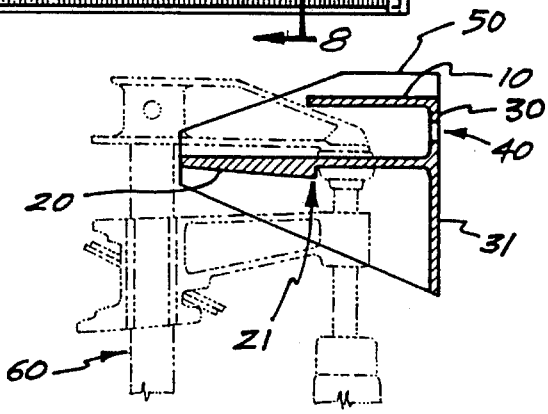
FIG. 8. A side view and section view of the second embodiment with profile of a stored bar clamp.
Figure 9:
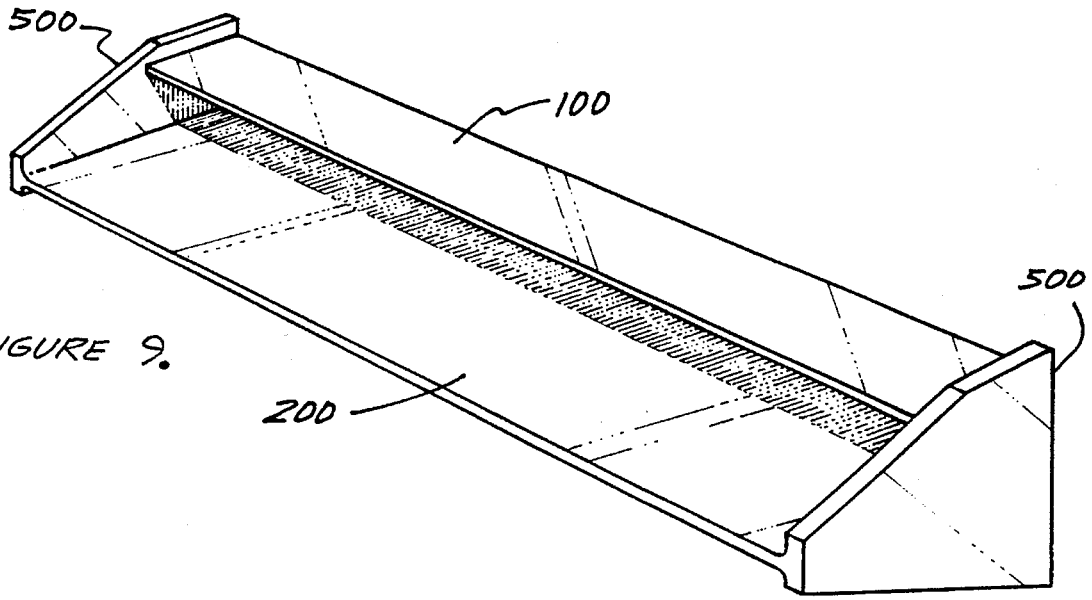
FIG. 9. A perspective view of the third embodiment of the BAR CLAMP HOLDER incorporating design modifications which allow the entirety of the holder to be manufactured in a one or two step casting process.
Figure 10:
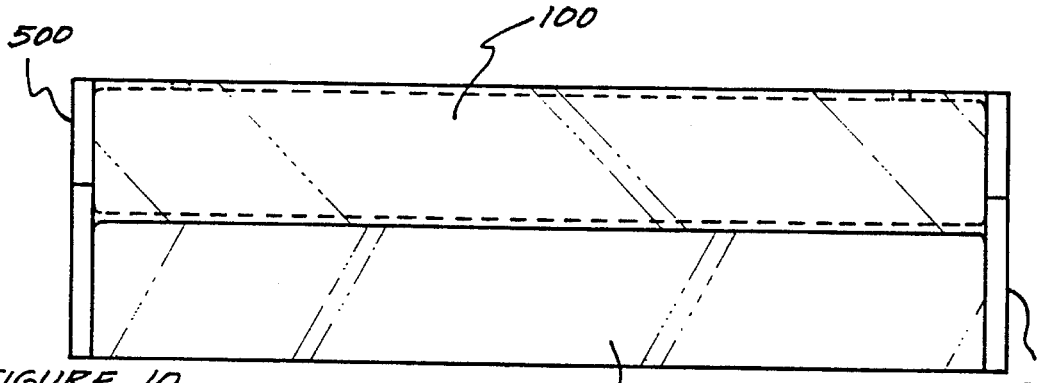
FIG. 10. Top view of the third embodiment.
Figure 11:
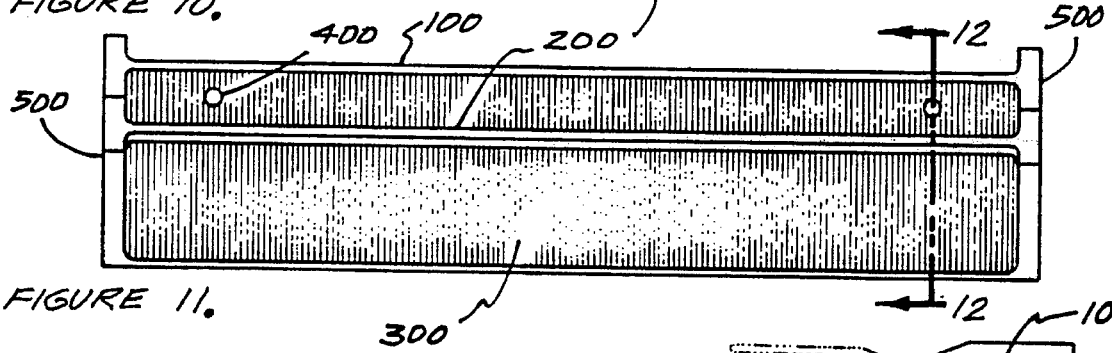
FIG. 11. Front view of the third embodiment showing the location of the two mounting holes.
Figure 12:
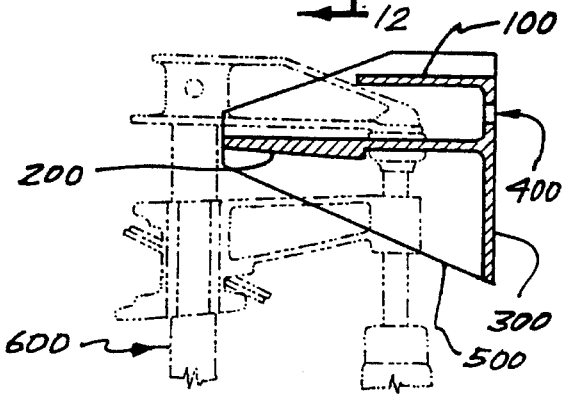
FIG. 12. A side view and section view of FIG. 9, indicating in phantom the mounting position of a stored bar clamp.

The BAR CLAMP HOLDER, as represented in FIGS. 1 through 12, is described, herein, as being optionally produced in three embodiments. The first embodiment, FIGS. 1 through 4, describe the holder as being fabricated from several individual parts and then assembled by means such as metal welding or other suitable process. The essential parts of this fabricated holder consists of the following:

1. The horizontal upper surface.
2. The horizontal lower surface.
3. The vertical mounting surface.
4. The two mounting holes.
5. The two end plates.

Represented in FIG. 1 is a bar clamp, 6, drawn with phantom lines and shown in a stored position on the lower horizontal surface. Annotated also are the three basic parts of a common bar clamp. These parts are the fixed jaw, *6a*, the movable jaw, *6b*, and the bar of the bar clamp, *6c*. A second bar clamp, 7, is shown in a phantom-in-action representation as the bar clamp is being put onto the holder. This is a one handed operation made possible by the capture of the nose portion of the bar clamp by the upper horizontal surface. This capture is indicated at 8. The existence of this upper surface and the relationship of the upper surface to the lower surface is the key ingredient of this invention and is the essence of the "capture and hold" concept as referred to earlier. The end plate, 5, performs two functions, one is to mechanically locate the upper, lower and vertical surfaces and the other function is to prevent the stored clamps from falling off the holder. Securing the holder to a wall or other vertical surface is via a fixing means such as screw fasteners passing through holes, 4, which are located in the vertical mounting surface, 3.

FIGS. 5 through 8 show the second embodiment of the BAR CLAMP HOLDER. The object of this design is to adapt the concept of the first embodiment to a different manufacturing process. This new process consists of extruding the upper, lower and vertical surfaces of the BAR CLAMP HOLDER in one integral and continuous piece. A separate operation would then cut the extrusion into finite lengths. Also included in this new manufacturing process is the molding in separate parts of the end plates (left and right). The essential parts of this second embodiment of the BAR CLAMP HOLDER are labeled as follows:

10. The horizontal upper surface or flange.
20. The horizontal lower surface or flange.
30. The vertical mounting surface or flange.
40. The two mounting holes.
50. The two molded end plates.

The design changes made necessary by the molded and extruded manufacturing processes are as follows:

The vertical mounting flange, 30, has been extended downward and is indicated at 31. This extension of the vertical mounting flange gives a greater wall mounting surface and a stronger cross-sectional area. The horizontal surface, 20, has been extended inward to meet and become an integral part of the vertical mounting flange, 30. This horizontal surface also incorporates a locking ridge, 21, which serves to maintain stored bar clamps on the holder. It is the intent of this extrusion process that all of the above flanges and surfaces are to be manufactured as a one piece extruded element. This element may be,made of various materials. The only criteria being that the material must exhibit the necessary structural and wearing qualities required by its use and must also exhibit the necessary characteristics required by the manufacturing process. The end plates, 50, are shown with a molded-in-place recess, 51, that exactly matches the one piece extruded cross-sectional area as described above, see FIG. 5. These end plates are to be fastened to the extruded section by chemical (metallic bonding agents or other) or chemical and/or mechanical means.

The third embodiment of the BAR CLAMP HOLDER is shown in FIGS. 9 through 12. The overall concept is essentially the same as that described in the second embodiment, but with detail changes required of the one piece molding process. The difference being that the end plates are molded in one operation with the flanges. A possible remaining operation to this third embodiment would be to establish the mounting holes, 400. The essential parts of the third embodiment of the BAR CLAMP HOLDER are labeled as follows:

100. The horizontal upper flange.
200. The horizontal lower flange.
300. The vertical mounting flange.
400. The two mounting holes.
500. The end plates of flanges.

We claim:

1. A bar clamp holder of finite length having an open mouth in the form of a U-shaped member, said U-shaped member comprising, a generally horizontal upper surface being of sufficient outward dimension so as to provide a means to overlay or capture the nose portion of the fixed jaw of a commonly proportioned bar clamp, a generally vertical support surface and being adapted to accept a fixing means, a generally horizontal lower surface extending or placed outward from said generally vertical support surface for a substantial portion of the width of the bar clamp holder so as to allow a means for the fixed and movable jaws of a commonly proportioned bar clamp to be closed around said lower surface, a generally vertical surface extending downward from said generally horizontal upper surface, a pair of end plates placed separately and located at each end of the upper and lower surfaces of the bar clamp holder and in the generally vertical plane that passes through the collective end surfaces of the upper surface and the lower surface.

2. A bar clamp holder of finite length having an open mouth in the form of a U-shaped member, said U-shaped member comprising a leg or web extending downward and being adapted to be flexibly located against a generally vertical surface, a generally horizontal upper flange being of sufficient outward dimension so as to provide a means to overlay or capture the nose portion of the fixed jaw of a commonly proportioned bar clamp, a generally horizontal lower flange or surface extending from and integral with said leg or web and projecting outward for a substantial portion of the width of the bar clamp holder so as to allow a means for the fixed and movable jaws of a commonly proportioned bar clamp to be secured to said lower surface, a retaining means located on the lower flange and extending the finite length of the lower flange and being of sufficient height as to provide a means of hindering the outward movement of a commonly proportioned bar clamp from the clamp holder, a pair of end plates placed separately and located at each end of the finite length of each clamp holder wherein the end plates are formed with an interlocking means which allows the end plates to be uniquely located against and connected to the end surfaces of the bar clamp holder.

3. A bar clamp holder as claimed in claim 2 wherein the end plates are molded integrally with the U-shaped member.

* * * * *